US008581507B2

(12) United States Patent
Corradi

(10) Patent No.: US 8,581,507 B2
(45) Date of Patent: Nov. 12, 2013

(54) LED LIGHTING APPARATUS WITH ADJUSTABLE LIGHTING INTENSITY

(75) Inventor: Danilo Corradi, Nibbiano (IT)

(73) Assignee: Artemide S.p.A., Milan (IT)

( * ) Notice: Subject to any disclaimer, the term of this patent is extended or adjusted under 35 U.S.C. 154(b) by 260 days.

(21) Appl. No.: 13/083,236

(22) Filed: Apr. 8, 2011

(65) Prior Publication Data

US 2011/0298386 A1 Dec. 8, 2011

(30) Foreign Application Priority Data

Apr. 9, 2010 (IT) ..... MI2010A0596

(51) Int. Cl.
*H05B 37/02* (2006.01)

(52) U.S. Cl.
USPC ..... 315/224

(58) Field of Classification Search
USPC ..... 315/307, 219, 209 R, 287, 291, 224
See application file for complete search history.

(56) References Cited

U.S. PATENT DOCUMENTS 8,106,596 B2 * 1/2012 Chang et al. ..... 315/219
2004/0135522 A1 7/2004 Berman et al.
2006/0267514 A1 11/2006 Xu
2009/0021182 A1 * 1/2009 Sauerlaender ..... 315/291
2010/0164393 A1 * 7/2010 Chang et al. ..... 315/279
2011/0101867 A1 * 5/2011 Wang et al. ..... 315/127

FOREIGN PATENT DOCUMENTS

DE 10013215 A1 9/2001

OTHER PUBLICATIONS

Italian Search Report of MI20100596 Dated Mar. 22, 2011.

* cited by examiner

*Primary Examiner* — Thienvu Tran
(74) *Attorney, Agent, or Firm* — Venable LLP; Robert Kinberg

(57) ABSTRACT

A LED lighting apparatus includes at least one LED lighting element, a control unit and a switching converter, for supplying the LED lighting element. A feedback circuit is connected between the LED lighting element and a ground line and co-operates with the switching converter for determining a LED current through LED lighting element. The feedback circuit has a first impedance in a first state, to which a non-zero first regulation value of the LED current corresponds, and a second impedance in a second state, to which a non-zero second regulation value of the LED current corresponds. The control unit is configured to cyclically switch the feedback circuit between the first state and the second state with a controllable duty-cycle.

11 Claims, 2 Drawing Sheets

LED LIGHTING APPARATUS WITH ADJUSTABLE LIGHTING INTENSITY

TECHNICAL FIELD

The present invention relates to a LED lighting apparatus with adjustable lighting intensity.

BACKGROUND OF THE INVENTION

It is known that LED lighting devices normally use switching supplies which allow, among other functions, to regulate the output intensity according to the user's commands.

A regulation mode of proven efficacy contemplates the use of a double pulse width modulation (or PWM) control.

Switching supplies are based on a first high-frequency PWM control by means of which the current which flows through the LED lighting elements is maintained about a reference value. More in detail, in LED lighting apparatuses, the switching supply comprises a switch, normally a MOSFET, connected between an input supply line and the LED lighting elements, and a control circuit. An inductor, connected between the switch and the LED lighting elements, is charged when the switch is closed and is discharged through the LED lighting elements and a recirculation diode when the switch is open. The control circuit, high-frequency control signal PWM (generally higher than 1 MHz), alternatively opens and closes the switch according to a duty-cycle determined according to the current absorbed by the LED lighting elements and to a reference, so as to control the charging and discharging of the inductor. The current which flows through the lighting elements is thus maintained about a desired operative value.

In order to vary the lighting intensity, a second low-frequency PWM control is used (e.g. from 100 Hz to 1 kHz). A second PWM signal, e.g. supplied by an external control unit, alternatively enables and disables the switching of the switch according to a duty-cycle fixed by the user through a command. In practice, during a portion of each period (active phase or "on" phase), the switch is controlled as described above and switches at high frequency. During the remaining portion of the period (inactive phase or "off" phase) the switch is deactivated and remains open, regardless of the conditions of the LED lighting elements. Once the inductor is completely discharged, the passage of current crossing the LED lighting elements ceases and the LEDs are cut off. The average current crossing the LED lighting elements and thus the lighting intensity are determined by the duty-cycle of the second PWM signal and by the current operating value when the switch is enabled.

Although very simple and effective, the use of the double PWM control for regulating the output intensity of LED lighting devices has some serious limitations.

As mentioned, in particular, the LEDs are cut off when the switch is deactivated by the low-frequency PWM signal. The lighting of the LEDs during the subsequent cycle causes a current peak which is short lasting but has considerable width, and is in all cases much higher than the usual operating current of the active phases, in which the switch is enabled. The lighting peaks subject the LEDs to stress which, given the very high number of cycles, may be damaged over time. On the other hand, the frequency of the second PWM signal cannot be reduced beyond a given limit because this would produce a flickering perceivable by the human eye. Therefore, a consequence of the type of described control is the reduction of the life of the LED lighting elements.

SUMMARY OF THE INVENTION

Thus, it is the object of the present invention to provide a LED lighting apparatus which allows to overcome the described limitations and, in particular, allows to extend the life of the LED lighting elements.

According to the present invention, a LED lighting apparatus as disclosed in claim 1 is provided.

BRIEF DESCRIPTION OF THE DRAWINGS

The present invention will now be described with reference to the accompanying drawings, which illustrate a non-limitative embodiment thereof, in which.

BEST MODE FOR CARRYING OUT THE INVENTION

Figure 1:
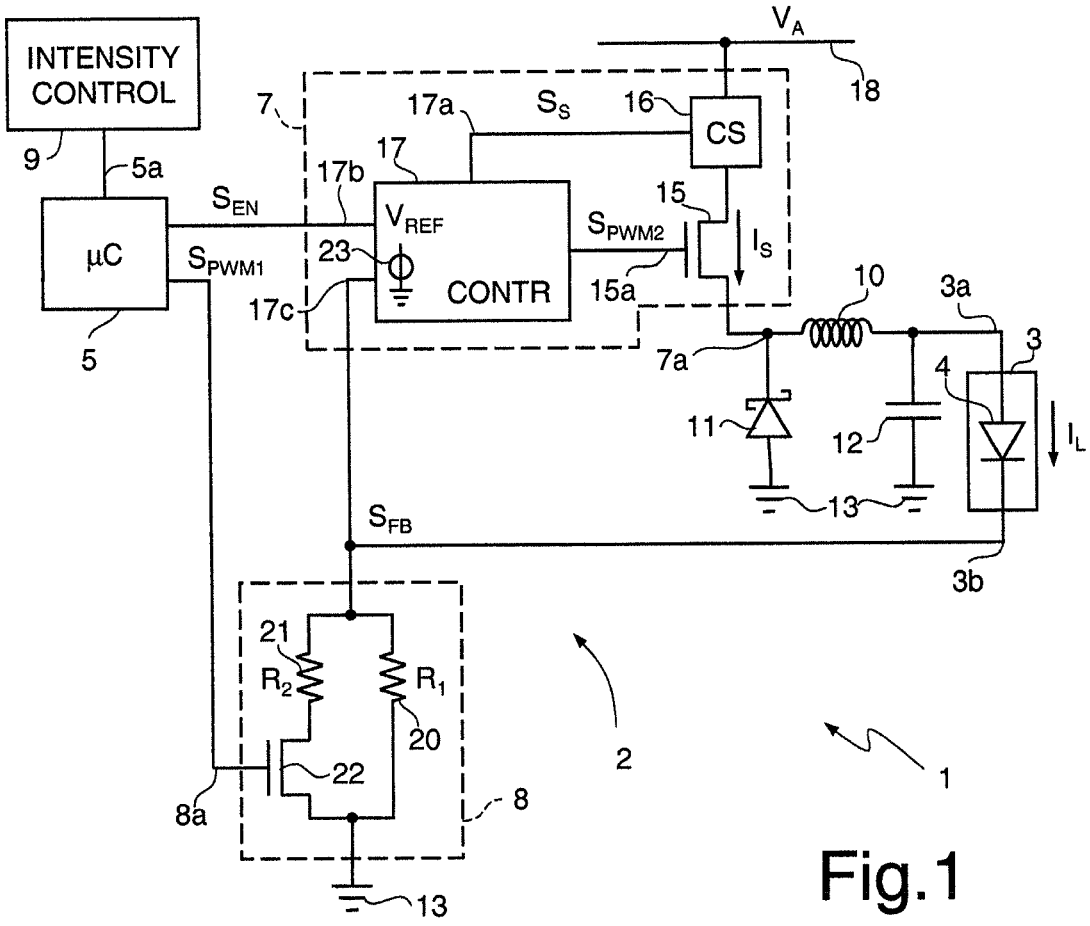
FIG. 1 is a simplified circuit diagram of a LED lighting apparatus in accordance with an embodiment of the present invention.

As shown in FIG. 1, a LED lighting apparatus 1 comprises a power supply 2 and at least one LED lighting module 3. The LED lighting module 3 comprises a plurality of LED sources 4 forming a matrix and coupled to the supply 2. For the sake of simplicity, FIG. 1 diagrammatically shows a single LED source 4.

The power supply 2 comprises a control unit 5, a switching converter 7, and a feedback circuit 8. Furthermore, an inductor 10, a recirculation diode 11 and a filter capacitor 12 are arranged between the converter 7 and the LED lighting module 3. The inductor 10 is connected between the output terminal 7*a* of the converter 7 and an anode terminal 3*a* of the LED lighting module 3; the recirculation diode 11 is connected between a ground line 13 and the output terminal 7*a* of the converter 7; and the filter capacitor 12 is connected between the ground line 13 and the anode terminal 3*a* of the LED lighting module 3.

The control unit 5, e.g. a microcontroller, provides an enabling signal EN to the converter 7 and a first control signal $S_{PWM1}$ to a control terminal of the feedback circuit 8. As mentioned more in detail below, the first control signal $S_{PWM1}$ is a low-frequency pulse width modulation signal (e.g. from 100 Hz and 1 kHz) and has a variable duty-cycle. In particular, the duty-cycle of the first control signal $S_{PWM1}$ may be set by a manual control 9, coupled to a reference input 5*a* of the control unit 5.

The converter 7 is in Buck configuration and comprises a switch 15, which in the described embodiment is an N-channel MOSFET, a current sensor 16 and a control circuit 17.

The switch 15 has a first conduction terminal (drain) connected to a power line 18, on which a direct power voltage $V_A$ is present and a second conduction terminal (source), which defines the output terminal 7*a* of the converter 7 and is connected to the LED lighting module 3 through the inductor 10. A control terminal 15*a* (gate) of the switch 15 is connected to an output of the control circuit 17 to receive a second control signal $S_{PWM2}$, as described below.

The current sensor 16 is arranged between the power line 18 and the first conduction terminal of the switch 15 and detects a switch current $I_S$ which flows through the switch 15. An output of the current sensor 16 provides a detection signal $S_S$, indicative of the switch current $I_S$, to a detection input 17*a* of the control circuit 17.

The control circuit 17 has an enable input 17*b*, connected to a corresponding enabling terminal of the control unit 5, for receiving an enable signal $S_{EN}$; and a feedback input 17*c*, connected to a cathode terminal 3*b* of the LED lighting module 3 and to the feedback circuit 8 to receive a feedback signal $S_{FB}$.

The feedback circuit 8 is connected between the cathode terminal 3*b* of the LED lighting module 3 and the ground line 13 and determines the feedback signal $S_{FB}$, which is indicative of a LED current $I_L$ flowing through the LED lighting module 3.

In the embodiment described here, the feedback circuit 8 comprises a first resistor 20, a second resistor 21 and a secondary switch 22 (herein an N-channel MOSFET), separate from the switch 15. Furthermore, the feedback circuit 8 has two states and is configured so that in one of the two states the LED current LED $I_L$ flows through either the first resistor 20 or the second resistor 21, while in the other of the two states, the first resistor 20 and the second resistor 21 both receives a respective fraction of the LED current $I_L$.

The first resistor 20 has a first constant resistance value $R_1$ and is connected between the cathode terminal 3*b* of the LED lighting module 3 and the ground line 13. The second resistor 21 has a second constant resistance value $R_2$ and a terminal connected to the cathode terminal 3*b* of the LED lighting module 3. A further terminal of the second resistor 21 is selectively connectable to the ground line 13 through the secondary switch 22. A control terminal (gate) of the secondary switch 22 defines the control terminal 8*a* of the reference circuit 8 and is connected to a respective output of the control unit 5 to receive the first control signal $S_{PWM1}$.

The feedback circuit 8 is controlled by the control unit 5. In the first state, the secondary switch 22 is open and the impedance between the cathode terminal 3*a* of the LED lighting module 3 and the ground line 13 is determined by the first resistor only 20. The second resistor 21 is indeed excluded and does not receive current from the LED lighting module 3. In the second state, the secondary switch 22 is closed and the second resistor 21 is inserted in parallel to the first resistor 20. The impedance between the cathode terminal 3*a* of the LED lighting module 3 and the ground line 13 is thus smaller than in the first state.

Thus, given the same LED current $I_L$ flowing through the LED lighting module 3, the feedback signal $S_{FB}$ (voltage, in the described embodiment) is higher when the feedback circuit 8 is in the first state, with higher impedance.

In use, the feedback circuit 8 cooperates with the converter 7 to determine the LED current $I_L$ through the LED lighting module 3. When the converter 7 is enabled by the control unit 5, the control circuit 17 sets the duty-cycle of the second high-frequency control signal $S_{PWM2}$ so as to obtain an average value of the LED current $I_L$ which is a function of an internal reference voltage $V_{REF}$ (diagrammatically represented by a reference voltage generator 23) of the feedback signal $S_{FB}$ and of the state of the feedback circuit 8.

More in detail, the control circuit 17 determines the duty-cycle of the second control signal $S_{PWM2}$ according to the difference between the feedback signal $S_{FB}$ and the inner reference voltage $V_{REF}$: if the feedback signal $S_{FB}$ increases, the duty-cycle of the second control signal $S_{PWM2}$ is reduced and, vice versa, if the feedback signal $S_{FB}$ decreases, the duty-cycle of the second control signal $S_{PWM2}$ is increased. When the stabilisation transients are over, the LED current $I_L$ is stabilised about a regulation value.

When the feedback circuit 8 is in the first state, the feedback signal $S_{FB}$, increases more rapidly than in the second state. The LED current $I_L$ is in fact set, in essence, by the inductor 10 and thus increases with the same rapidity, regardless of the state of the feedback circuit 8, which has however different impedances in the two states.

Figure 2:
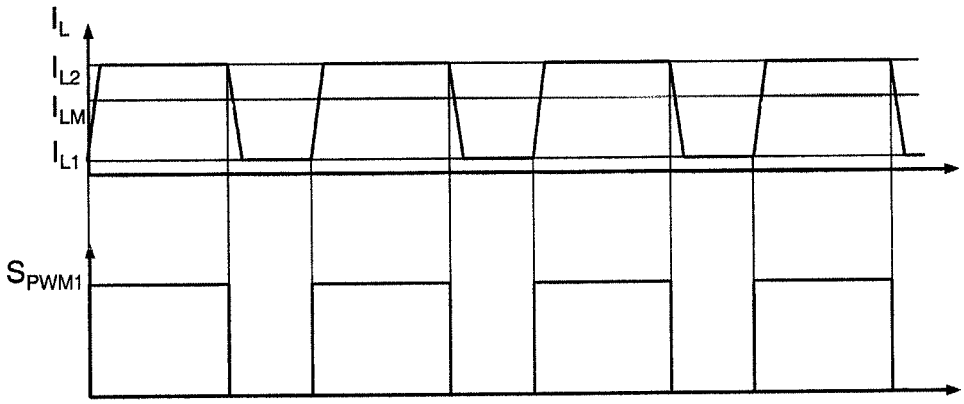
FIG. 2 is a chart showing magnitudes related to the apparatus in FIG. 1.

The switching condition of the switch 15 is thus reached more rapidly and with lower LED current $I_L$ in the first state, and more slowly and with higher LED current $I_L$ in the second state. The duty-cycle of the second control signal $S_{PWM2}$ is influenced as a consequence and is lower in average when the feedback circuit 8 is in the first state. As shown in FIG. 2, as a consequence, the LED current $I_L$ has a non-zero first regulation value $I_{L1}$, when the feedback circuit 8 is in the first state, and a second regulation value $I_{L2}$, higher than the first regulation value $I_{L1}$, when the feedback circuit 8 is in the second state.

The duty-cycle of the first low-frequency control signal $S_{PWM1}$ which is set by the user through the manual control 9, determines the ratio between permanence times of the feedback circuit 8 in the first state and in the second state and thus the average value $I_{LM}$ of the LED current $I_L$. In turn, the average value $I_{LM}$ of the LED current $I_L$ determines the output intensity of the LED lighting module 3.

Advantageously, the power supply 2 is made so that the LED current $I_L$ is never zero and thus the LEDs 4 of the LED lighting module 3 always remain powered, without being cut off. The switch 15 is active and takes part in the high-frequency regulation also when the first control signal $S_{PWM1}$ takes the feedback circuit 8 to the first state, to which the lower regulation value of the LED current $I_L$ corresponds. Because LEDs 4 are conductive in all cases, the current peaks are greatly limited when the LED current $I_L$ passes from the first regulation value $I_{L1}$ to the second regulation value $L_{L2}$. The LED 4 are thus preserved from possible damage and their lifespan is extended.

Figure 3:
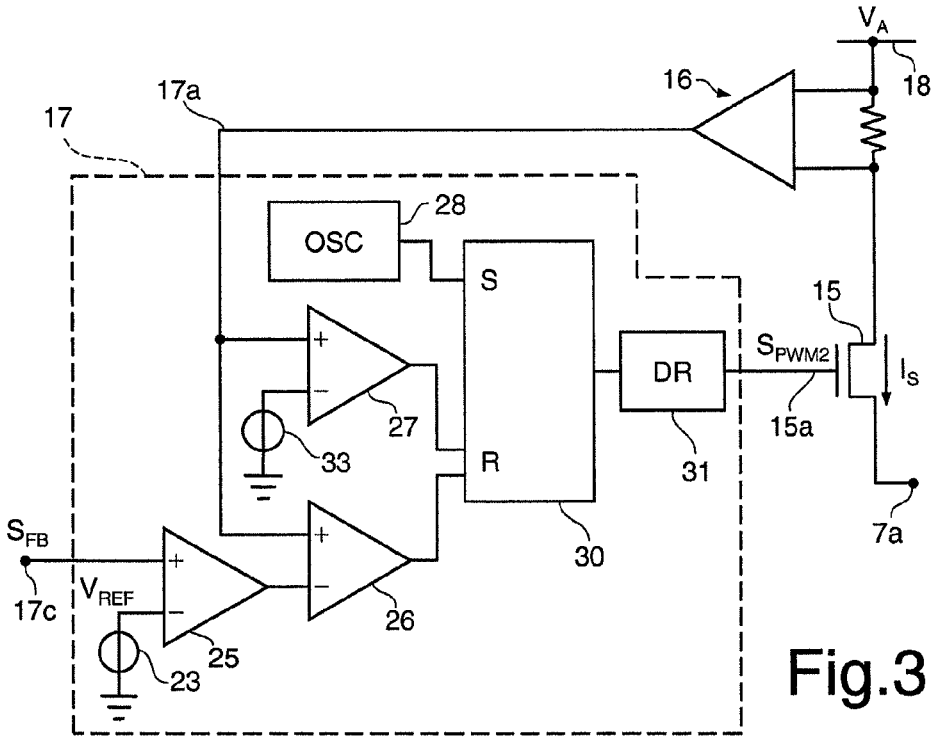
FIG. 3 is a more detailed circuit diagram of a portion of the apparatus in FIG. 1.

FIG. 3 shows an embodiment of the converter 7. In the described embodiment, the converter 7 comprises, in addition to the reference voltage generator 23, an error amplifier 25, a first comparator 26, a second comparator 27, an oscillator 28, a bistable circuit 30 and a driving circuit 31.

The error amplifier 25, of the integral type, has inputs respectively connected to the cathode terminal 3*a* of the LED lighting module 3 and to the reference voltage generator 23 for receiving the feedback signal $S_{FB}$ and the reference voltage $V_{REF}$ respectively. The output of the error amplifier 25 is connected to an input of the first comparator 26, a second input of which defines the detection terminal 7*a* of the converter 7 and receives the detection signal $S_S$ from the current sensor 6. The second comparator 27 also receives the detection signal $S_S$ and an input connected to a further reference voltage generator 33, which provides an end-of-cycle reference voltage $V_{EC}$. The outputs of the first comparator 26 and of the second comparator 27 are both connected (in OR) to a reset input of the bistable circuit 30. The set input of the bistable circuit 30 is connected to an output of the oscillator 28. Both set and reset inputs of the bistable circuit 30 respond to leading edges of the respective signals.

The driving circuit 31 is controlled by the bistable circuit 30 and provides the second control signal $S_{PWM2}$ to the driving terminal 15*a* of the switch 15 to alternatively open and close the switch 15 itself. In detail, the driving circuit 31 closes the switch 15 when the output of the bistable circuit 30 is high; when instead the output of the bistable circuit 30 is low, the switch 15 is opened.

At the beginning of each cycle of the second control signal $S_{PWM2}$, the oscillator 28 takes the output of the bistable circuit 30 to high state and causes the closing of the switch 15, which starts conducting, making the LED current $I_L$ grow.

The error comparator 25 integrates the difference between reference voltage $V_{REF}$ and feedback signal $S_{FB}$, which represents the LED current $I_L$, and the first comparator 26 compares the result of the integration with the detection signal $S_S$. When the detection signal $S_S$ exceeds the output of the error comparator 25, the first comparator 26 switches and takes the output of the bistable circuit 30 to the low state, causing the opening of the switch 15. If the LED current $I_L$ is not sufficient in order for the detection signal $S_S$ to exceed the output value of the error comparator 25 before the end of the cycle of the second control signal $S_{PWM2}$, the output of the bistable circuit 30 is taken to the low state by the second comparator 27, which switches when the reference signal $S_S$ reaches the end-of-cycle reference voltage $V_{EC}$.

Figure 4:
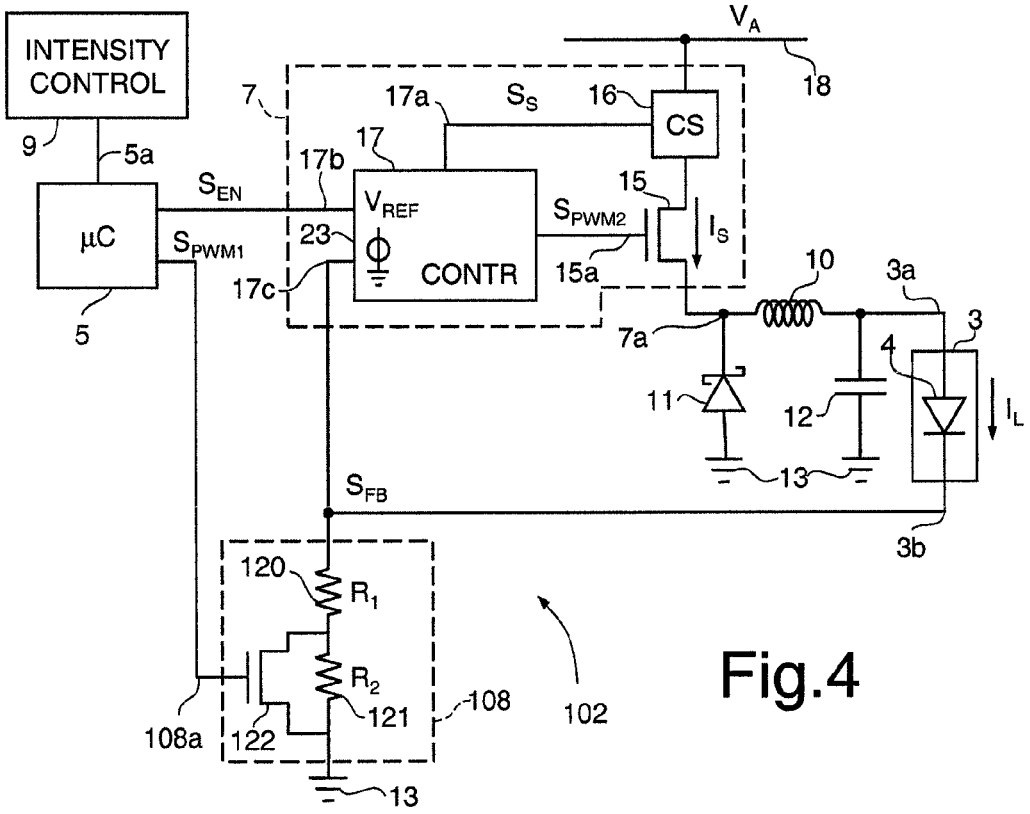
FIG. 4 is a simplified block chart of a LED lighting apparatus according to a different embodiment of the present invention.

According to the embodiment of the invention shown in FIG. 4, in which parts equal to those already illustrated are designated by the same reference numerals, a lighting apparatus 100 comprises a power supply 102 and the LED lighting module 3, coupled thereto. The power supply 102 comprises, in turn, the control unit 5, the converter 7, the inductor 10, the recirculation diode 11 and the filter capacitor 12, as already described above and further more a feedback circuit 108.

The feedback circuit 108 comprises a first resistor 120, a second resistor 121 and a second switch 122, also in this case an N-channel MOSFET. Furthermore, the feedback circuit 108 has two states and is configured so that in one of the two states the LED current LED $I_L$ flows through only one of the first resistor 120 and the second resistor 121, while in the other of the two states, the first resistor 120 and the second resistor 121 both receive a respective fraction of the LED current $I_L$.

The first resistor 120 and the second resistor 121 have respectively a first resistance value $R_1$ and a second resistance value $R_2$, which are constant and, with the secondary switch 122 open, are connected in series between the cathode terminal 3*b* of the LED lighting module LED 3 and the ground line 13. The second switch 122 has conduction terminals connected to respective terminals of one of the resistors 120, 121, here the second resistor 121. Furthermore, a control terminal (gate) of the secondary switch 22 defines the control terminal 108*a* of the reference circuit 108 and is connected to a respective output of the control unit 5 to receive the first control signal $S_{PWM1}$.

The feedback circuit 108 is controlled by the control unit 5. In the first state, the secondary switch 122 is open and the impedance between the cathode terminal 3*a* of the LED lighting module 3 and the ground line 13 is determined by the series of the first resistor 120 and of the second resistor 121. In the second state, the secondary switch 122 is closed and thus the second resistor 121 is excluded. The impedance between the cathode terminal 3*a* of the LED lighting module 3 and the ground line 13 is thus lower than in the first state.

It is finally apparent that changes and variations may be made to the apparatus described, without departing from the scope of the present invention, as defined in the appended claims.

The switching converter, in particular, may be of different type than that described. For example, it is possible to use a variable frequency switching converter. In this case, the active step (the "on" step) of the switch of the converter starts when the detected LED current drops under a threshold and has fixed duration, controlled by a first counter. The switch of the converter switches at the end of the active phase. The active phase has minimum duration, determined by a second counter and is possibly prolonged if, once the minimum duration has elapsed, the LED current is still higher than the threshold. In this case, the cycles of the high frequency control signal have variable duration.

It is further apparent that either the first resistor or the second resistor may be excluded to modify the impedance of the feedback circuit. In limit conditions, both the first resistor and the second resistor could be provided with respective switches. In this manner, both may be turned on and off, obtaining greater control flexibility. Possibly, the first resistor and the second resistor, with respective separate resistance values, may be alternatively connected in series to the LED lighting element, one in the first state and the other in the second state.

The invention claimed is:

1. Lighting apparatus comprising:

at least one LED lighting element;

a control unit;

a switching converter, having a supply input, connectable to a supply line for receiving an input supply voltage ($V_A$), and an output for supplying the at least one LED lighting element;

a feedback circuit, connected between a terminal of the at least one LED lighting element and a constant potential line and co-operating with the switching converter for determining a LED current ($I_L$) through the at least one LED lighting element;

wherein the feedback circuit has, in a first state, a first impedance value ($R_1$) between the terminal of the at least one LED lighting element and the constant potential line to which a non-zero first regulation value ($I_{L1}$) of the LED current ($I_L$) corresponds, and, in a second state, has a second impedance value ($R_2$) between the terminal of the at least one LED lighting element and the constant potential line to which a non-zero second regulation value ($I_{L2}$) of the LED current ($I_L$) corresponds, and wherein the control unit is configured to cyclically switch the feedback circuit between the first state and the second state with a controllable duty-cycle.

2. Lighting apparatus comprising:

at least one LED lighting element;

a control unit;

a switching converter, having a supply input, connectable to a supply line for receiving an input supply voltage ($V_A$), and an output for supplying the at least one LED lighting element;

a feedback circuit, connected between a terminal of the at least one LED lighting element and a constant potential line and co-operating with the switching converter for determining a LED current ($I_L$) through the at least one LED lighting element;

wherein the feedback circuit has a first impedance ($R_1$) in a first state, to which a non-zero first regulation value ($I_{L1}$) of the LED current ($I_L$) corresponds, and a second impedance ($R_2$) in a second state, to which a non-zero second regulation value ($I_{L2}$) of the LED current ($I_L$) corresponds, wherein the control unit is configured to cyclically switch the feedback circuit between the first state and the second state with a controllable duty-cycle; and wherein the feedback circuit comprises a first resistive element and a second resistive element, connected between a cathode terminal of the at least one LED lighting element and the constant voltage line, and a first switch, separate from the first resistive element and from the second resistive element and controlled by the control unit to selectively exclude either the first resistive element or the second resistive element in either the first or the second state.

3. Apparatus according to claim 2, wherein the feedback circuit is configured so that in one of the first state and the second state the LED current ($I_L$) flows through only one of the first resistive element and the second resistive element.

4. Apparatus according to claim 3, wherein in the other of the first state and the second state, the first resistive element and the second resistive element both receive at least one respective fraction of the LED current ($I_L$).

5. Apparatus according to claim 2, wherein the feedback circuit is configured so that the first resistive element receives at least a respective fraction of the LED current ($I_L$) in at least one of the first state and the second state and the second resistive element receives at least a respective fraction of the LED current ($I_L$) in at least one of the first state and the second state.

6. Apparatus according to claim 2, wherein the first resistive element and the second resistive element are resistors having constant respective resistances ($R_1$, $R_2$).

7. Apparatus according to claim 2, wherein the first resistive element is connected between the cathode terminal of the at least one LED lighting element and the constant voltage line, and the second resistive element is selectively connectable in parallel to the first resistive element through the first switch.

8. Apparatus according to claim 2, wherein the first resistor and the second resistor are connected in series between the cathode terminal of the at least one LED lighting element and the constant voltage line, when the first switch is open, and the first switch has conduction terminals connected to respective terminals of one between the first resistor and the second resistor.

9. Apparatus according to claim 2, wherein the switching converter comprises:

a second switch, separate from the first switch, having a first conduction terminal, connectable to the supply line, and a second conduction terminal, coupled to an anode terminal of the at least one LED lighting element; and a control circuit, having a feedback input, connected to the feedback circuit for receiving a feedback signal ($S_{FB}$), and an output terminal, coupled to a control terminal of the second switch;

and wherein the control circuit is configured to control the second switch on the basis of the feedback signal ($S_{FB}$) and of a reference signal ($V_{REF}$).

10. Apparatus according to claim 9, wherein the control circuit is configured to provide the control terminal of the second switch with a switching signal ($S_{PWM2}$) having a duty-cycle and to set the duty-cycle of the switching signal ($S_{PWM2}$) on the basis of the feedback signal ($S_{FB}$) and of the reference signal ($V_{REF}$).

11. Lighting apparatus comprising:

at least one LED lighting element;

a control unit, a switching converter, having a supply input, connectable to a supply line for receiving an input supply voltage ($V_A$) and an output for supplying the at least one LED lighting element;

a feedback circuit, connected between a terminal of the at least one LED lighting element and a constant potential line and co-operating with the switching converter for determining a LED current ($I_L$) through the at least one LED lighting element;

wherein the feedback circuit has a first impedance ($R_1$) in a first state, to which a non-zero first regulation value ($I_{L1}$) of the LED current ($I_L$) corresponds, and a second impedance ($R_2$) in a second state to which a non-zero second regulation value ($I_{L2}$) of the LED current ($I_L$) corresponds, wherein the control unit is configured to cyclically switch the feedback circuit between the first state and the second state with a controllable duty-cycle; and wherein the control unit is configured to provide to a control terminal of the feedback circuit a pulse-width-modulation control signal ($S_{PWM1}$) and the feedback circuit is configured to switch between the first state and the second state in response to the pulse-width-modulation control signal ($S_{PWM1}$).

* * * * *